US010994924B2

(12) United States Patent
Rosumowitsch

(10) Patent No.: US 10,994,924 B2
(45) Date of Patent: May 4, 2021

(54) HOPPER BOTTOM FOR GRAIN STORAGE BIN

(71) Applicant: Michael Rosumowitsch, Brandon (CA)

(72) Inventor: Michael Rosumowitsch, Brandon (CA)

( * ) Notice: Subject to any disclaimer, the term of this patent is extended or adjusted under 35 U.S.C. 154(b) by 128 days.

(21) Appl. No.: 16/517,813

(22) Filed: Jul. 22, 2019

(65) Prior Publication Data

US 2020/0031571 A1 Jan. 30, 2020

Related U.S. Application Data

(60) Provisional application No. 62/702,710, filed on Jul. 24, 2018.

(51) Int. Cl.

| | |
|---|---|
| ***F26B 17/12*** | (2006.01) |
| ***B65D 88/72*** | (2006.01) |
| ***F26B 25/06*** | (2006.01) |
| ***B65D 88/74*** | (2006.01) |

(52) U.S. Cl.

CPC ..... *B65D 88/72* (2013.01); *B65D 88/742* (2013.01); *F26B 25/06* (2013.01)

(58) Field of Classification Search

CPC ..... F26B 25/06; F26B 17/12; B65D 88/72; B65D 88/742; B65D 88/741; B65D 88/28

USPC ..... 34/170, 165, 168, 174

See application file for complete search history.

(56) References Cited

U.S. PATENT DOCUMENTS

2013/0295833 A1* 11/2013 Thiessen ..... B65D 88/28 454/178

2019/0329971 A1* 10/2019 Siemens ..... B65D 3/06

* cited by examiner

*Primary Examiner* — John P McCormack

(74) *Attorney, Agent, or Firm* — Ryan W. Dupuis; Kyle R. Satterthwaite; Ade & Company Inc.

(57) ABSTRACT

A hopper bottom a grain bin above a foundation includes a conical wall tapering inwardly to a bottom discharge opening. An outer cylindrical wall is joined to the top peripheral edge of the conical wall. Upright support legs are connected to the outer wall for supporting the cylindrical grain bin walls thereabove. A bottom wall is connected radially between the outer wall and the conical wall so as to define a manifold passage bounded by the conical wall, the outer wall and the bottom wall which is generally annular in shape and which is located externally of the conical wall. Vent openings are formed in the conical wall to receive aeration air from a blower connected to the manifold passage. A cover member is supported above the vent openings in the conical wall in connection with the outer wall above the conical wall to prevent material entering the vent openings.

16 Claims, 6 Drawing Sheets

HOPPER BOTTOM FOR GRAIN STORAGE BIN

This application claims the benefit under 35 U.S.C. 119(e) of U.S. provisional application Ser. No. 62/702,710, filed Jul. 24, 2018.

FIELD OF THE INVENTION

The present invention relates to a hopper bottom for supporting a storage bin thereon, for example a grain storage bin having a cylindrical side wall, and more particularly the present invention relates to a hopper bottom comprising a conical wall having an inverted cone shape which tapers downwardly and inwardly from a surrounding cylindrical outer wall that supports the grain bin thereon to a central bottom discharge in which an manifold is mounted externally about a bottom side of the conical wall to direct a flow of air upwardly into the grain storage bin through the conical wall.

BACKGROUND

Particulate material storage bins are commonly used on farms for storing the grain. One known type of storage bin comprising a cylindrical bin wall supported above a hopper bottom having a conical wall tapering downwardly and inwardly from the cylindrical bin wall to a central bottom discharge. Legs support the conical wall so that the discharge is spaced above the ground sufficient to receive the inlet hopper of grain transferring equipment under the discharge. The hopper bottom may be formed integrally with the grain bin or may be formed as a separate component upon which a commercially available cylindrical bin is then subsequently attached.

Examples of grain drying through a hopper cone are disclosed in U.S. Pat. No. 5,604,994 by Annen et al. and U.S. Pat. No. 4,520,714 by Gullickson. In the prior art examples considerable ducting or multiple blowers are required to communicate ventilation air to the various perforated sections in the hopper cone.

SUMMARY OF THE INVENTION

According to one aspect of the invention there is provided a hopper bottom for supporting a cylindrical side wall of a grain bin above a foundation, the hopper bottom comprising:

a conical wall having an inverted cone shape so as to taper downwardly and inwardly from a peripheral edge at a top end of the conical wall to a discharge opening at a bottom end of the conical wall;

an outer wall which is generally cylindrical in shape and which is joined to the peripheral edge of the conical wall, the outer wall being arranged for connection to the cylindrical side wall of the grain bin for supporting the grain bin thereabove;

a plurality of upright support legs connected to the outer wall at circumferentially spaced apart positions to extend downwardly therefrom so as to support the discharge opening at the bottom end of the conical wall spaced above a ground surface upon which bottom ends of the support legs are engaged;

a bottom wall connected radially between the outer wall and the conical wall at a location spaced below the peripheral edge of the conical wall and extending about a full circumference so as to define a manifold passage bounded by the conical wall, the outer wall and the bottom wall which is generally annular in shape and which is located externally of the conical wall;

a plurality of vent openings formed in an upper portion of the conical wall in communication from the manifold passage to an interior of the conical wall; and an inlet opening extending through at least one of the outer wall or the bottom wall that is arranged for communication with a blower so as to be arranged to direct ventilation air from the blower and into the grain bin through the manifold passage and the vent openings.

Use of the exterior of the conical wall and the cylindrical outer rim of hopper bottom as boundaries of an aeration distribution manifold provides even distribution of aeration air about the perimeter of the storage in a manner which is simple and low cost to manufacture. The bottom wall of the manifold also acts as a strengthening gusset of material connected between the conical wall and the outer wall about the full perimeter of the hopper bottom so that the hopper bottom can effectively support large volume cylindrical bin structures thereon.

Preferably the bottom wall is oriented horizontally and is nearer to the peripheral edge of the conical wall than the bottom end of the conical wall such that the manifold passage has a generally triangular cross-sectional shape defined by the conical wall, the outer wall and the bottom wall respectively.

The support legs thus typically extend through the bottom wall.

The inlet opening for communication with the blower is preferably located in the bottom wall.

In some embodiments, the hopper bottom may further include a cover member supported internally above the conical wall at a location spaced above the vent openings. The cover member may be supported spaced above the conical wall by a plurality of radially oriented support ribs connected between the cover member and the conical wall at circumferentially spaced apart positions.

A plurality of vent openings may also be provided in the cover member for directing air into the into of the bin either through the vent openings in the cover member or the gap between the cover member and the conical wall at the inner end of the cover member.

The vent openings in the cover member are preferably closer to the bottom end of the conical wall than the vent openings in the conical wall.

The vent openings in the cover member preferably also have respective cross-sectional areas which are smaller than cross-sectional areas of the vent openings in the conical wall.

The cover member is preferably joined to the outer wall about a full perimeter of the outer wall.

An inner end of the cover member may movable upwardly relative to the conical wall for cleanout access, for example by forming the cover member of flexible material, or alternatively forming the cover member in rigid sections which are pivotally coupled to the outer wall.

A blower may be directly mounted on the bottom wall such that the blower is suspended wholly from the bottom wall in communication with the inlet opening.

An access opening may be provided in the bottom wall together with a cover which is selectively mounted on said at least one access opening for closing the access opening.

BRIEF DESCRIPTION OF THE DRAWINGS

One embodiment of a hopper bottom for a grain storage bin with integral aeration will now be described in conjunction with the accompanying drawings in which.

In the drawings like characters of reference indicate corresponding parts in the different figures.

DETAILED DESCRIPTION

Figure 1:
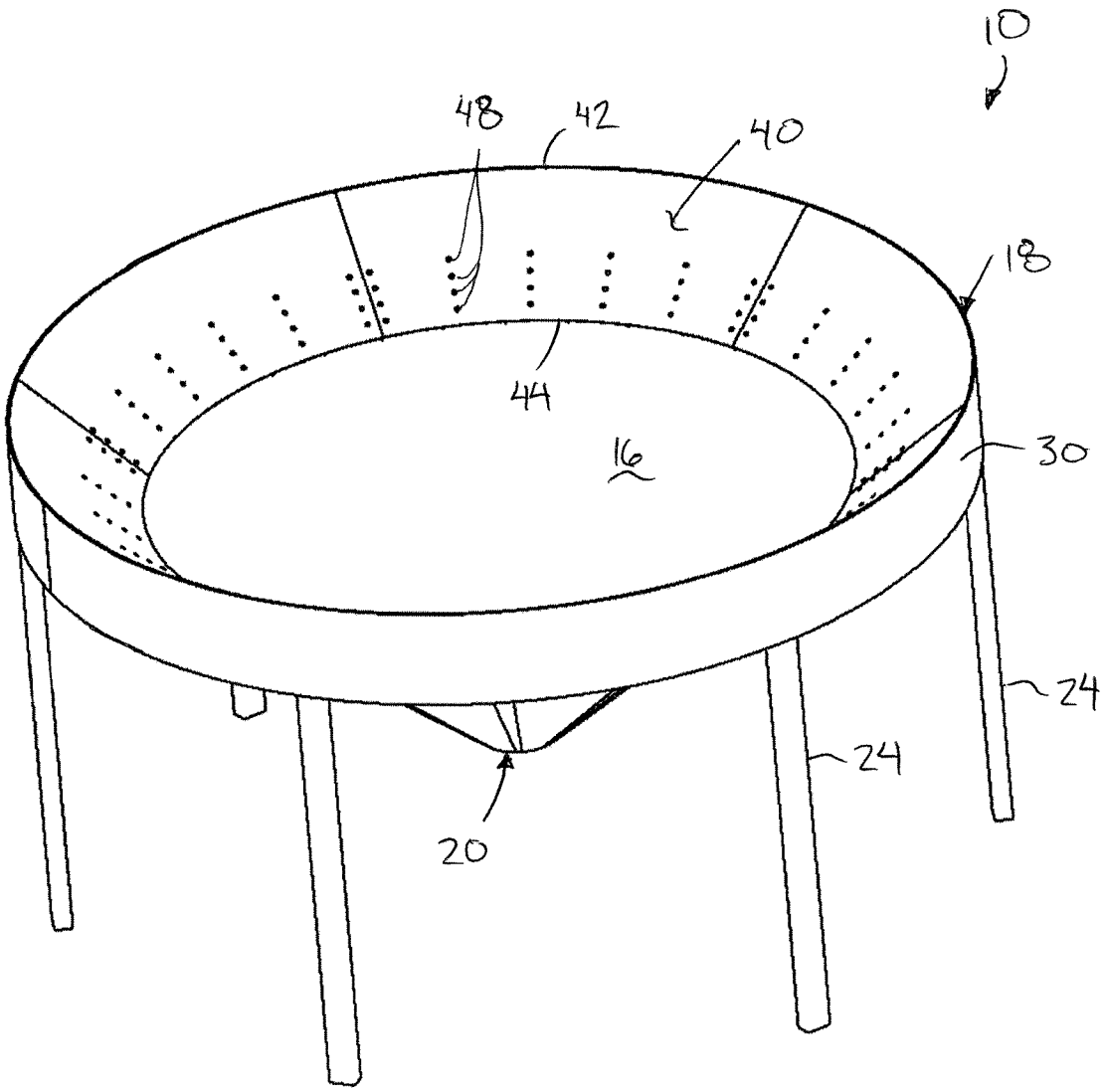
FIG. 1 is a perspective view of a top side of the hopper bottom for supporting a grain storage bin thereon.
Figure 2:
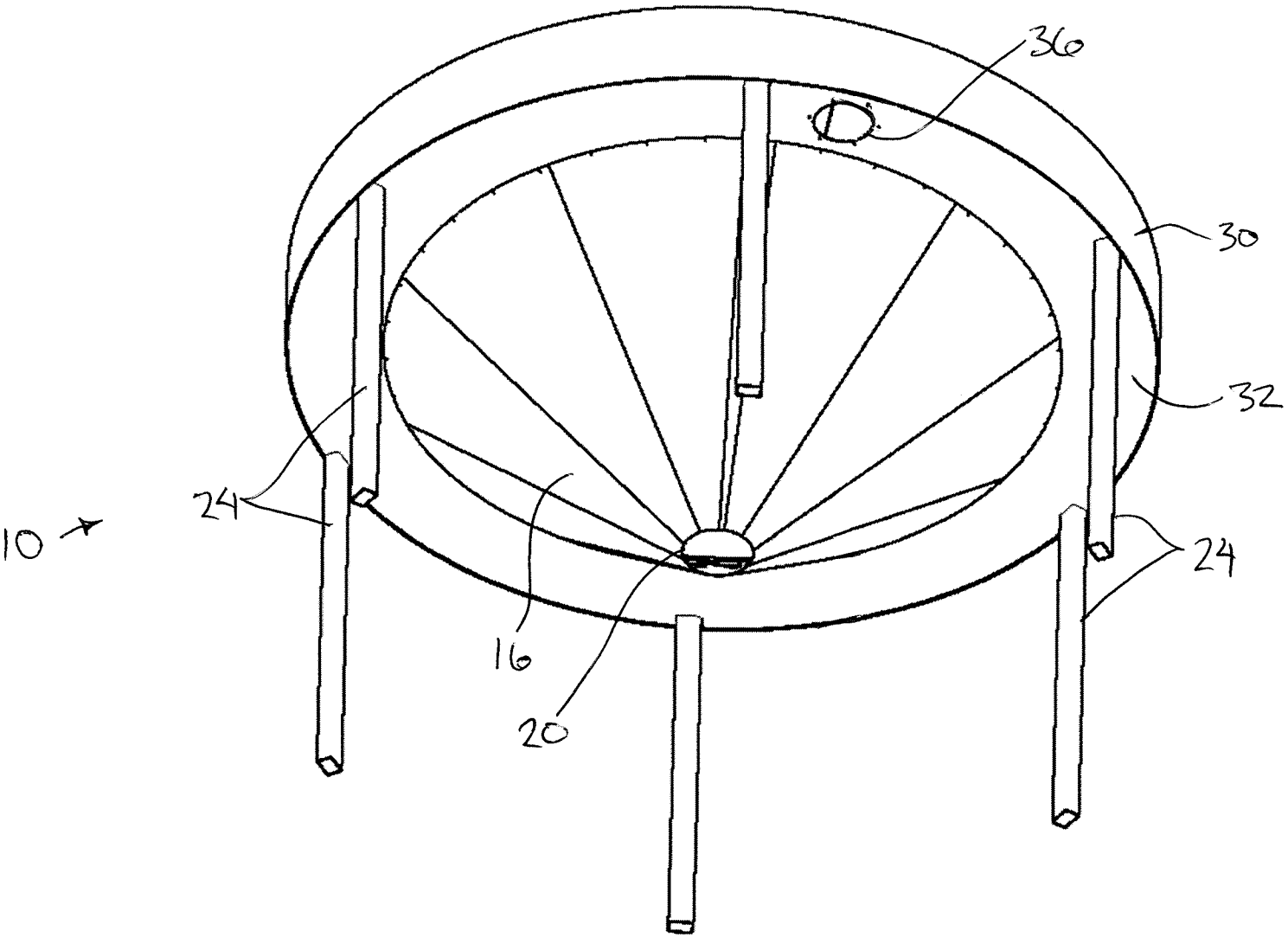
FIG. 2 is a perspective view of a bottom side of the hopper bottom.
Figure 4:
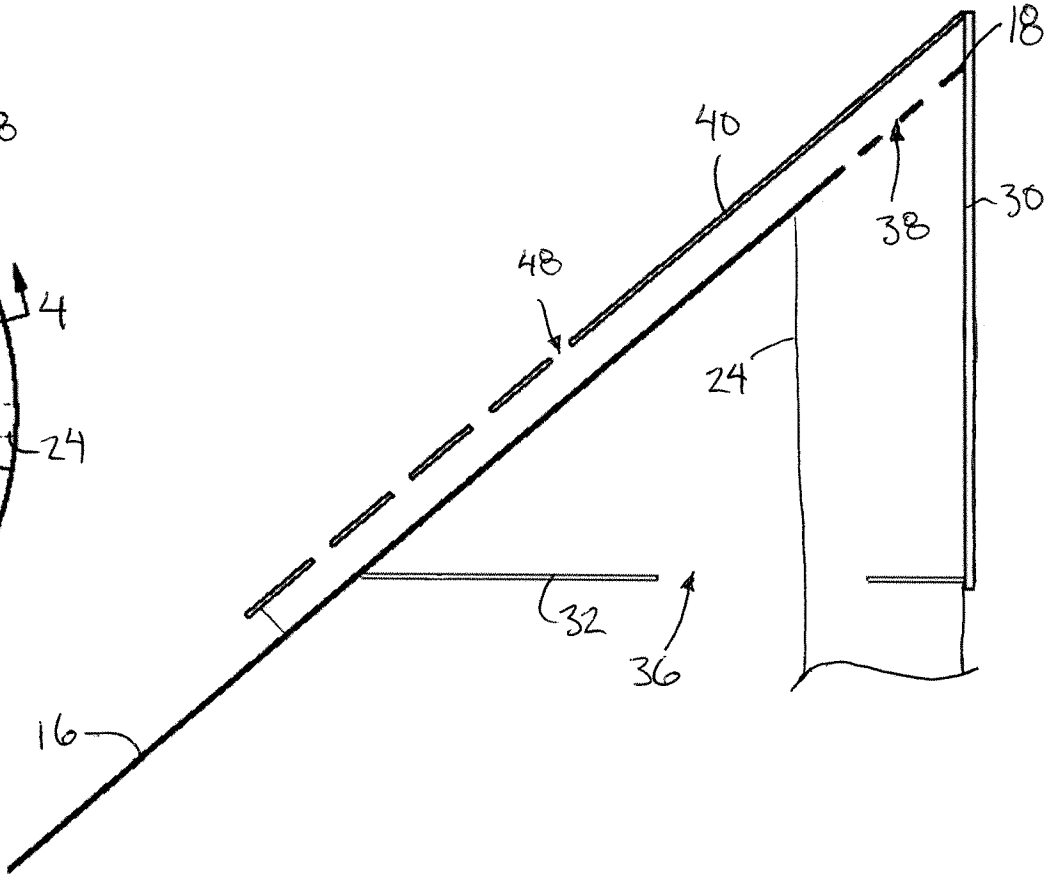
FIG. 4 is a sectional view along the line 4-4 in FIG. 3.
Figure 3:
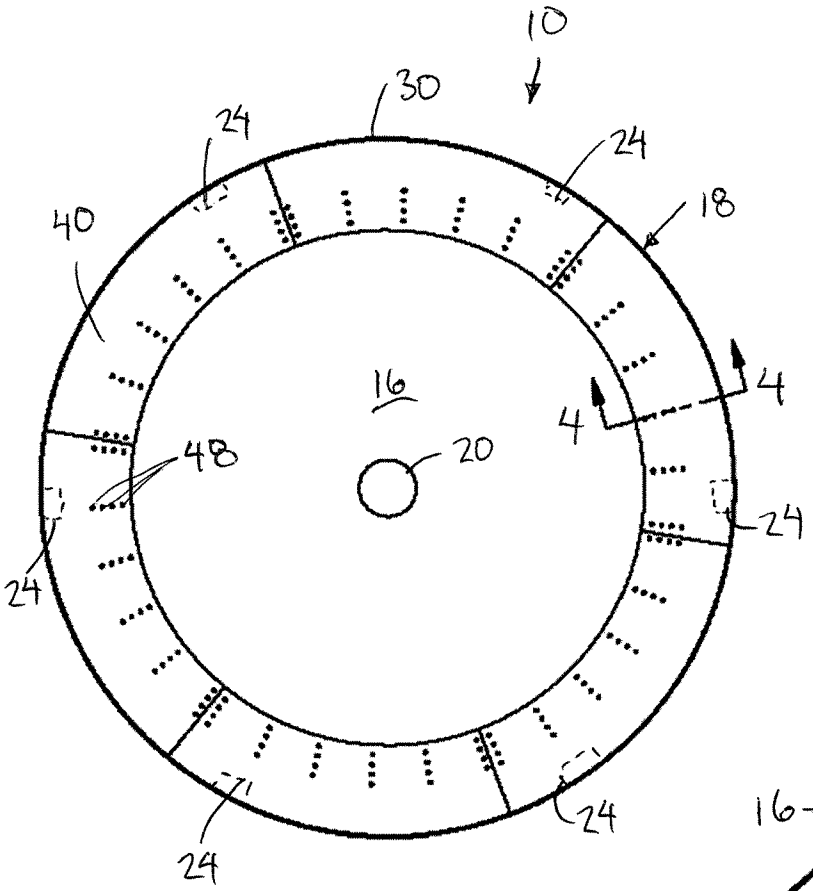
FIG. 3 is a top plan view of the hopper bottom.
Figure 5:
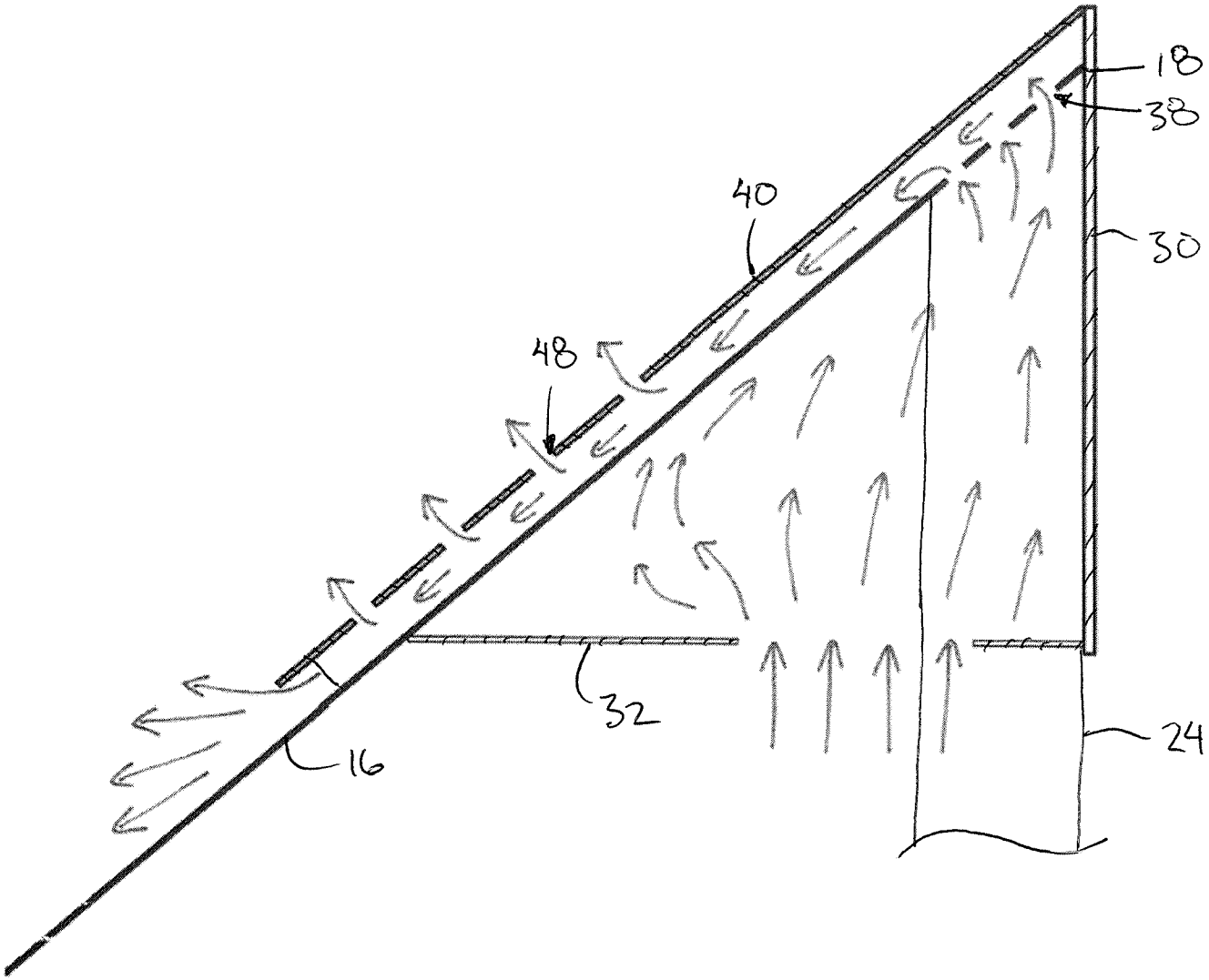
FIG. 5 is another sectional view similar to FIG. 4 illustrating an aeration flow path through the hopper bottom.
Figure 6:
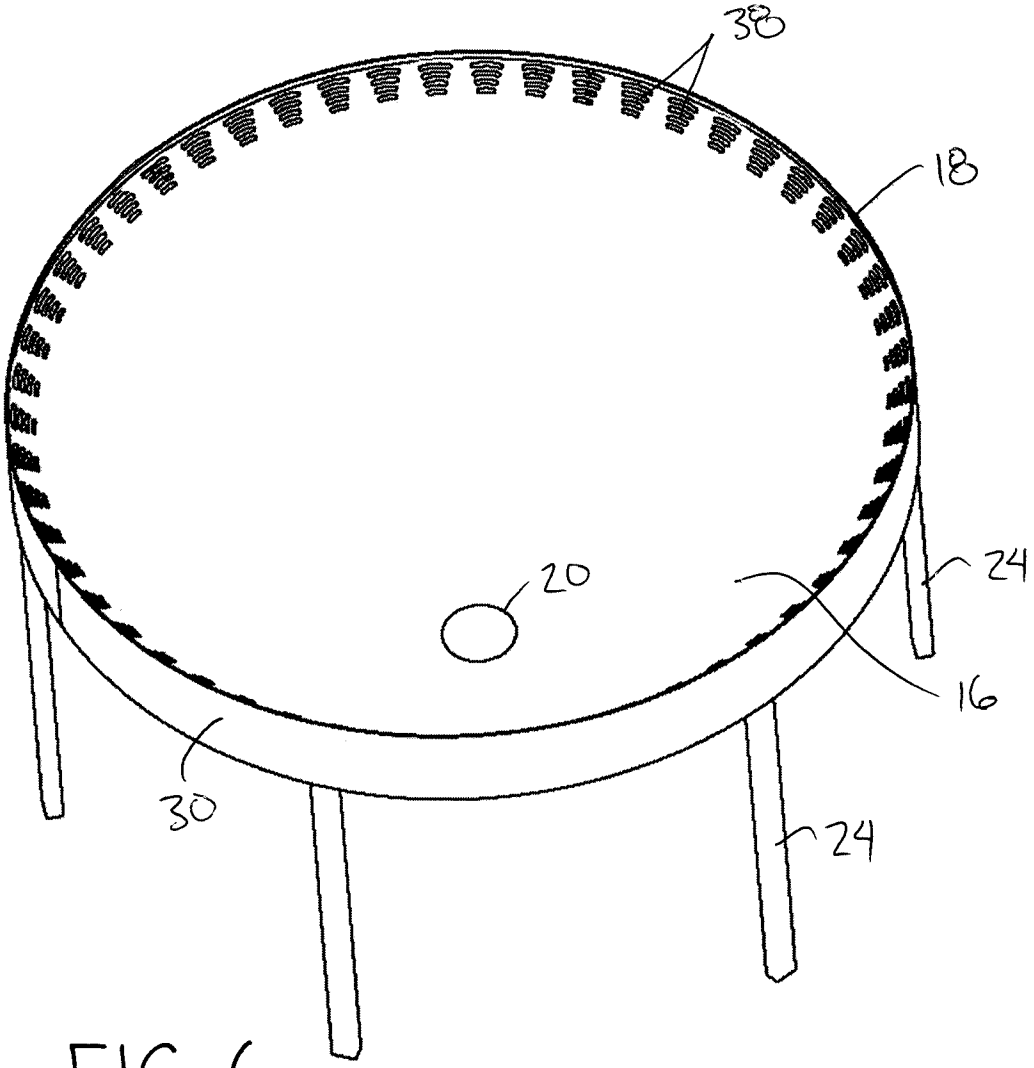
FIG. 6 is a perspective view of the hopper bottom with the internal cover shown removed.
Figure 7:
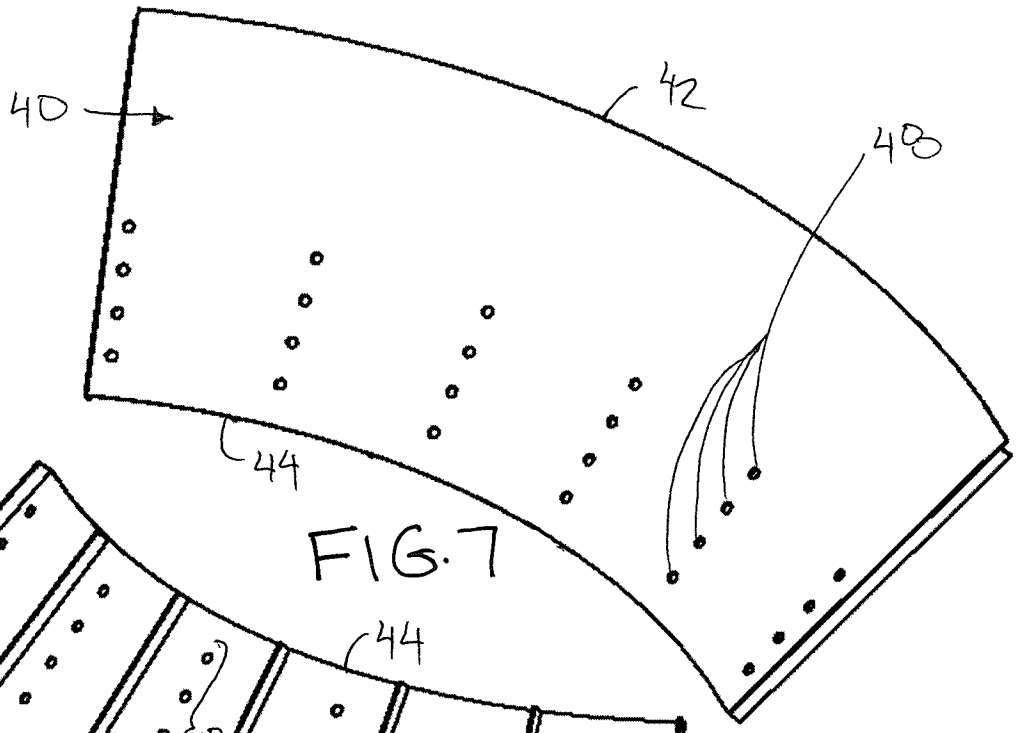
FIG. 7 is a perspective view of a top side of a section of the internal cover shown removed from the hopper bottom.
Figure 8:
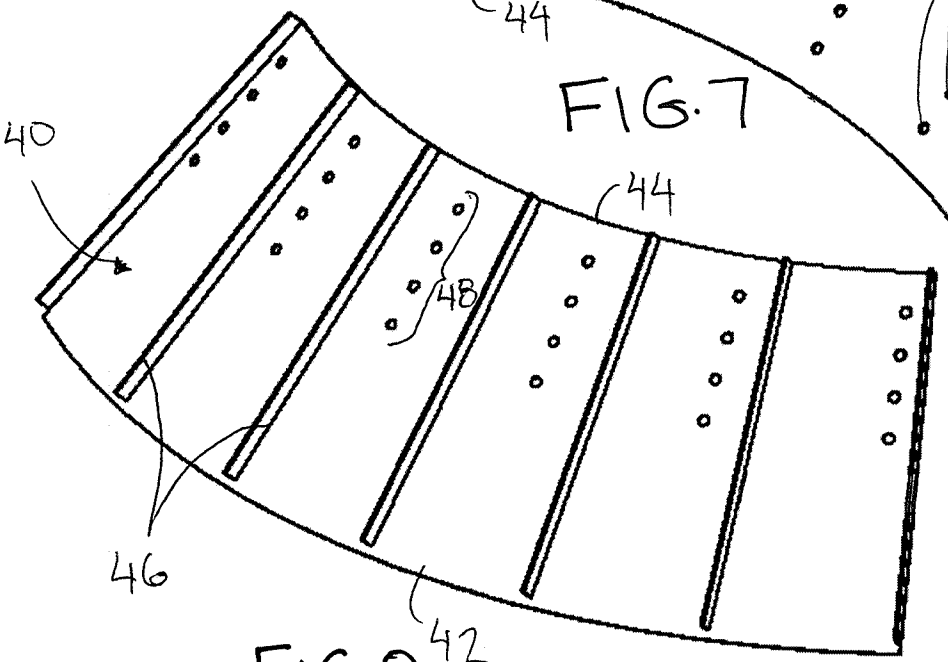
FIG. 8 is a perspective view of a bottom side of the section of the internal cover according to FIG. 7.

Referring to the accompanying figures, there is illustrated a grain storage bin hopper bottom generally indicated by reference numeral 10.

The hopper bottom 10 is particularly suited for a bin of the type comprising a cylindrical side wall extending vertically upward to be enclosed at the top end by a top wall (not shown). The top wall is typically conical in shape so as to taper upwardly and radially inwardly to a central opening at the top of the bin which can be selectively enclosed by a lid (not shown). The details of cylindrical grain storage bin are well known to persons of skill in the art and will not be described further herein.

The hopper bottom 10 includes a conical wall 16 which is generally in the shape of an inverted cone. Accordingly, the hopper wall tapers downwardly and radially inwardly from an upper peripheral edge 18 at the top end of the conical wall about the circumference of the hopper bottom towards a central discharge opening 20 at the bottom end of the conical wall. The upper surface of the conical wall 16 forms part of the lower boundary of an interior cone shaped volume of the hopper which is open to the hollow interior of the grain storage bin supported thereabove. A conventional gate assembly (not shown) is mounted at the bottom end of the conical wall for operation between open and closed positions relative to the central discharge opening 20.

A set of support legs 24 are mounted at evenly spaced apart positions about the circumference of the conical wall to extend vertically downwardly from the peripheral edge 18 thereof. Each support leg 24 is fixed to the bottom surface of the conical wall such that an outer side of the support leg is substantially flush with the peripheral edge 18 of the conical wall. The support legs are similar in height for spanning a common vertical distance between a bottom end and a top end at the peripheral edge 18 of the conical wall. The height of the support legs 24 is such that when the bottom ends of the support legs are commonly engaged upon a suitable foundation, for example a ground surface or a concrete foundation pad on the ground, the gate assembly at the central discharge opening at the bottom of the conical wall is located spaced above the foundation by a suitable clearance for receiving the inlet hopper of suitable grain transfer equipment therebetween.

The hopper bottom 10 further includes an outer wall 30 in the form of a cylindrical rim extending vertically downward from the peripheral edge 18 of the hopper wall. The outer wall 30 is formed of sufficiently rigid material so as to be suitable for forming a lap joint in bolted or welded connection to the bottom edge of the cylindrical wall 14 of the grain storage bin to be supported above the hopper bottom.

The support legs 24 are typically arranged so that the outer side of each support leg is flush against the inner surface of the cylindrical outer wall 30 along an upper portion of the support leg adjacent the top end thereof. The top end of the support leg is sloped to match the downward and inward slope of the bottom side of the conical wall 16 against which the top end of the post is abutted. The support legs thus form a rigid structural connection between the conical wall and the outer wall at circumferentially spaced positions about the hopper bottom.

The hopper bottom further includes a bottom wall 32 which extends generally horizontally and radially inwardly from the bottom end of the outer wall 30 to be joined to the bottom surface of the conical wall 16 at the inner end of the bottom wall about the full perimeter thereof. The bottom wall is spaced below the upper peripheral edge of the conical wall by the height of the outer wall 30 but remains much closer in height to the upper peripheral edge than the bottom of the conical wall or the bottom of the support legs.

The bottom wall 32 thus forms the lower boundary of a manifold passage 34 which is generally annular about the full circumference of the hopper bottom at a location externally of the conical wall 16. The remainder of the manifold passage is bounded by the outer wall 30 and the upper portion of the conical wall 16 so that the manifold passage is generally triangular in cross section.

An upper portion of each support leg extends through a corresponding opening in the bottom wall 32 so as to be received within the manifold passage, however the bottom wall 32 remains in sealed connection about each support leg passing therethrough. The bottom wall spans a radial distance which is several times greater than the radial thickness of the legs so that the legs do not substantially interfere with circumferential flow of air through the manifold passage which is otherwise uninterrupted about the circumference of the hopper bottom.

An inlet opening 36 is located within the bottom wall at a single location for connection to a suitable inlet duct (not shown) which extends vertically downward from the inlet opening by a height of the support legs. In this manner when the bottom ends of the support legs are supported on a suitable foundation, a suitable blower resting on the foundation (not shown) may be connected to the bottom end of the inlet duct for directing aeration air from the blower upwardly through the inlet duct and into the manifold passage through the inlet openings 36.

Alternatively, a blower may be directed mounted on an exterior side of the bottom wall 32 of the manifold. In this manner, the blower is protected from weather including rain and the like by being positioned closely below the hopper and is protected from dirt and grain on the ground by locating the blower spaced above the ground. By hanging the blower directly below the manifold, the blower is also out of the way and non-obstructive to activities on the ground below the hopper such as placement of the loading hopper of a conveyor below the hopper discharge gate.

In addition to the inlet opening 36, the bottom wall may also include a plurality of access openings (not shown) formed in the bottom wall. Each access opening includes a cover (not shown) which is selectively mounted on the access opening for close the access opening. The cover may be a flat, rigid plate of material which is bolted to the bottom wall about the periphery of the access opening so as to be readily removable for cleanout access of the manifold duct if desired.

A plurality of ventilation apertures 38 are located in the upper portion of the conical wall 16 that forms part of the boundary of the manifold passage such that the vent apertures 38 are in communication from the manifold passage below the conical wall to the interior volume of the hopper bottom above the conical wall. The vent apertures 38 are located only along an uppermost portion of the conical wall 16 nearest to the upper perimeter edge. The ventilation apertures are provided at radially spaced locations and circumferentially spaced locations within the conical wall while being shaped to be generally elongate in the circumferential direction.

To prevent stored granular materials from entering the ventilation apertures 38, a suitable cover member 40 is provided within the interior of the conical wall 16. The cover member comprises a generally frustoconical wall which is sloped downwardly and inwardly from an upper edge 42 joined to the outer wall 30 to an inner edge 44 in close proximity to but is spaced slightly below the location on the conical wall 16 where the inner end of the bottom wall 32 is connected. The cover member thus serves to span over the upper portion of the conical wall that forms the boundary of the manifold passage 34 while being parallel and spaced slightly above the upper surface of the conical wall by a series of support ribs 46 acting as spacers.

The support ribs comprise elongate rigid members which protrude downwardly from the wall forming the cover member 40 while being oriented to extend radially from the upper edge 42 to the inner edge 44. The height of the ribs 46 defines the height of the space between the upper surface of the conical wall 16 and the lower surface of the cover member. Each adjacent pair of ribs in the circumferential direction defines an aeration channel therebetween communicating generally downwardly and inwardly from an upper end in communication with respective ones of the vent apertures 38 in the conical wall to a bottom end which is open to the interior of the conical volume of the hopper bottom about the full perimeter of the inner edge 44 of the cover member. The inner end of the cover member 40 is closer to the upper peripheral edge of the conical wall than the central discharge opening 20 at the bottom end of the conical wall.

A plurality of vent apertures 48 are also located in the cover member 40, but only in the lower half of the cover member such that all of the vent apertures 48 in the cover member are situated downwardly and inwardly, closer to the bottom end of the conical wall, in relation to the vent apertures 38 in the upper portion of the conical wall 16. The ventilation apertures 48 in the cover member are much smaller in dimension or cross-sectional area than the vent apertures 38 in the conical wall. More particularly the vent apertures 48 in the cover have a diameter which is smaller than the expected diameter of the granular particles stored within the grain bin so as to prevent passage of the stored material through the vent apertures from the area immediately above the cover member 40 to the area between the cover member and the upper portion of the conical wall 16. In this manner, any aeration air directed from the manifold passage through the upper portion of the conical wall 16 is subsequently directed downwardly within the gap between the cover member 40 and the conical wall 16 therebelow. The aeration air is then able to be both directed upwardly through the vent apertures 48 in the cover member as well as being directed downwardly and radially inwardly into the interior volume of the hopper bottom through the open ends of the channels between the inner end of the cover member 40 and the conical wall 16 therebelow.

The cover member 40 may be formed in the arcuate sections connected together to collectively extend about the full circumference of the hopper bottom. In some instances, the cover member is formed of rigid material, for example metal, in which individual arcuate sections are hinged at the upper peripheral edge to the outer wall 30 so that the cover member can be lifted at the inner end thereof relative to the conical wall to provide cleanout access below the cover member.

Alternatively the cover member may be formed of a somewhat flexible material, for example a plastic material, which is sufficiently rigid to maintain the wall of the cover member spaced above the conical wall 16 as a result of the support by the radial ribs 46, while remaining sufficiently flexible that the inner end of the cover member can be lifted upwardly relative to the conical wall 16 therebelow by flexing of the cover member to provide cleanout access to the area between the cover member and the conical wall 16.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A hopper bottom for supporting a cylindrical side wall of a grain bin above a foundation, the hopper bottom comprising:

a conical wall having an inverted cone shape so as to taper downwardly and inwardly from a peripheral edge at a top end of the conical wall to a discharge opening at a bottom end of the conical wall;

an outer wall which is generally cylindrical in shape and which is joined to the peripheral edge of the conical wall, the outer wall being arranged for connection to the cylindrical side wall of the grain bin for supporting the grain bin thereabove;

a plurality of upright support legs connected to the outer wall at circumferentially spaced apart positions to extend downwardly therefrom so as to support the discharge opening at the bottom end of the conical wall spaced above a ground surface upon which bottom ends of the support legs are engaged;

a bottom wall connected radially between the outer wall and the conical wall at a location spaced below the peripheral edge of the conical wall and extending about a full circumference so as to define a manifold passage bounded by the conical wall, the outer wall and the bottom wall which is generally annular in shape and which is located externally of the conical wall;

a plurality of vent openings formed in an upper portion of the conical wall in communication from the manifold passage to an interior of the conical wall; and an inlet opening extending through at least one of the outer wall or the bottom wall that is arranged for communication with a blower so as to be arranged to direct ventilation air from the blower and into the grain bin through the manifold passage and the vent openings.

2. The hopper bottom according to claim 1 wherein the bottom wall is nearer to the peripheral edge of the conical wall than the bottom end of the conical wall.

3. The hopper bottom according to claim 1 wherein the bottom wall is oriented horizontally.

4. The hopper bottom according to claim 1 wherein the manifold passage has a generally triangular cross-sectional shape defined by the conical wall, the outer wall and the bottom wall respectively.

5. The hopper bottom according to claim 1 wherein the support legs extend through the bottom wall.

6. The hopper bottom according to claim 1 wherein the inlet opening is located in the bottom wall.

7. The hopper bottom according to claim 1 further comprising a cover member supported internally above the conical wall at a location spaced above the vent openings.

8. The hopper bottom according to claim 7 wherein the cover member is supported spaced above the conical wall by a plurality of radially oriented support ribs connected between the cover member and the conical wall at circumferentially spaced apart positions.

9. The hopper bottom according to claim 7 further comprising a plurality of vent openings in the cover member.

10. The hopper bottom according to claim 9 wherein the vent openings in the cover member are closer to the bottom end of the conical wall than the vent openings in the conical wall.

11. The hopper bottom according to claim 9 wherein the vent openings in the cover member have respective cross-sectional areas which are smaller than cross-sectional areas of the vent openings in the conical wall.

12. The hopper bottom according to claim 7 wherein the cover member is joined to the outer wall about a full perimeter of the outer wall.

13. The hopper bottom according to claim 12 wherein an inner end of the cover member is movable upwardly relative to the conical wall.

14. The hopper bottom according to claim 13 wherein the cover member is formed of flexible material.

15. The hopper bottom according to claim 6 in combination with a blower directly mounted on the bottom wall such that the blower is suspended wholly from the bottom wall in communication with the inlet opening.

16. The hopper bottom according to claim 1 further comprising at least one access opening formed in the bottom wall and a cover which is selectively mounted on said at least one access opening for closing the access opening.

* * * * *